US010960519B2

(12) United States Patent
Wu

(10) Patent No.: US 10,960,519 B2
(45) Date of Patent: Mar. 30, 2021

(54) PLIERS

(71) Applicant: Ming Chieh Wu, Taichung (TW)

(72) Inventor: Ming Chieh Wu, Taichung (TW)

( * ) Notice: Subject to any disclaimer, the term of this patent is extended or adjusted under 35 U.S.C. 154(b) by 239 days.

(21) Appl. No.: 16/137,740

(22) Filed: Sep. 21, 2018

(65) Prior Publication Data

US 2020/0039032 A1 Feb. 6, 2020

(30) Foreign Application Priority Data

Aug. 2, 2018 (TW) ..... 107126884

(51) Int. Cl.
*B25B 7/02* (2006.01)
*B25B 7/08* (2006.01)

(52) U.S. Cl.
CPC . *B25B 7/02* (2013.01); *B25B 7/08* (2013.01)

(58) Field of Classification Search
CPC .. B25B 7/02; B25B 7/08; B25B 7/123; B25B 13/505; B25B 7/04; B25B 7/06; B25B 7/10; B25C 11/02; A61C 3/14
See application file for complete search history.

(56) References Cited

U.S. PATENT DOCUMENTS 2,407,990 A * 9/1946 Lurie ..... B25B 13/32 81/118
2,847,889 A * 8/1958 Cain ..... B25B 7/02 81/424.5
6,393,951 B1 * 5/2002 Jansson ..... B25B 7/02 81/167
6,923,697 B1 8/2005 Wagner
8,656,812 B2 2/2014 Kawai et al.
2016/0160615 A1 * 6/2016 Greci ..... E21B 43/08 166/278

FOREIGN PATENT DOCUMENTS

| | | | |
|---|---|---|---|
| CN | 101790437 | A | 7/2010 |
| CN | 106695597 | A | 5/2017 |
| DE | 29908119 | U1 | 8/1999 |
| JP | 2004330348 | A | 11/2004 |
| JP | 2005279801 | A | 10/2005 |
| JP | 2013043220 | A | 3/2013 |
| TW | M400391 | U | 3/2011 |
| TW | M412843 | U | 10/2011 |

* cited by examiner

*Primary Examiner* — Robert J Scruggs
(74) *Attorney, Agent, or Firm* — Alan D. Kamrath; Karin L. Williams; Mayer & Williams PC

(57) ABSTRACT

A pair of pliers includes a first clamping member and a second clamping member pivotally connected together. Front ends of the first and second clamping members respectively include first and second clamping sides for clamping an object therebetween. The first and second clamping sides are disposed adjacent to each other and face oppositely. The second clamping side has a first clamping portion which defines a clamping recess which extends transversely to a longitudinal direction of the second clamping side. The clamping recess has opposite first and second sides. The clamping recess has a serrated bottom side. The serrated bottom side includes a first high tooth and at least one tooth. The first high tooth has a greater depth than the at least one tooth. Tips of the first high tooth and the at least one tooth extend longitudinally between the first and second sides of the clamping recess.

18 Claims, 16 Drawing Sheets

PLIERS

BACKGROUND OF THE INVENTION

1. Field of the Invention

The present invention relates to pliers and, particularly, to a pair of pliers that can grip an object firmly.

2. Description of the Related Art

Refer to Taiwan Pat. No. M400391, a pair of pliers for a user to hold and turn an object includes a first body and a second body pivotally connected to each other. The pair of pliers includes a symmetrical clamping end for gripping the object. The clamping end includes a first flat clamping side on the first body and a second flat clamping side on the second body. Each of the first and second clamping sides has a flat base and a plurality of teeth of equal height protruding from the base. Peaks of the plurality of teeth extend parallel to one another and in a direction parallel to a rotating axis of the object. The plurality of teeth can minimize the slipping. However, it is still desirable to overcome the problem that the plurality of teeth is prone to slip on the object when the object needs to be turned with a large torque.

The present invention is, therefore, intended to obviate or at least alleviate the problems encountered in the prior art.

SUMMARY OF THE INVENTION

According to the present invention, a pair of plier includes a first clamping member and a second clamping member pivotally connected to the first clamping member. Front ends of the first and second clamping members respectively include first and second clamping side for clamping an object therebetween. The first and second clamping sides extend in a longitudinal direction along longitudinal directions of the respective first and second clamping members. The first and second clamping sides are disposed adjacent to each other and face oppositely. The second clamping side has a first clamping portion which defines a clamping recess. The clamping recess has opposite first and second sides which extend transversely to the longitudinal direction of the second clamping side. The clamping recess has a serrated bottom side. The serrated bottom side includes a first high tooth and at least one tooth. The first high tooth has a greater depth than the at least one tooth. Tips of the first high tooth and the at least one tooth extend longitudinally between the first and second sides of the clamping recess.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
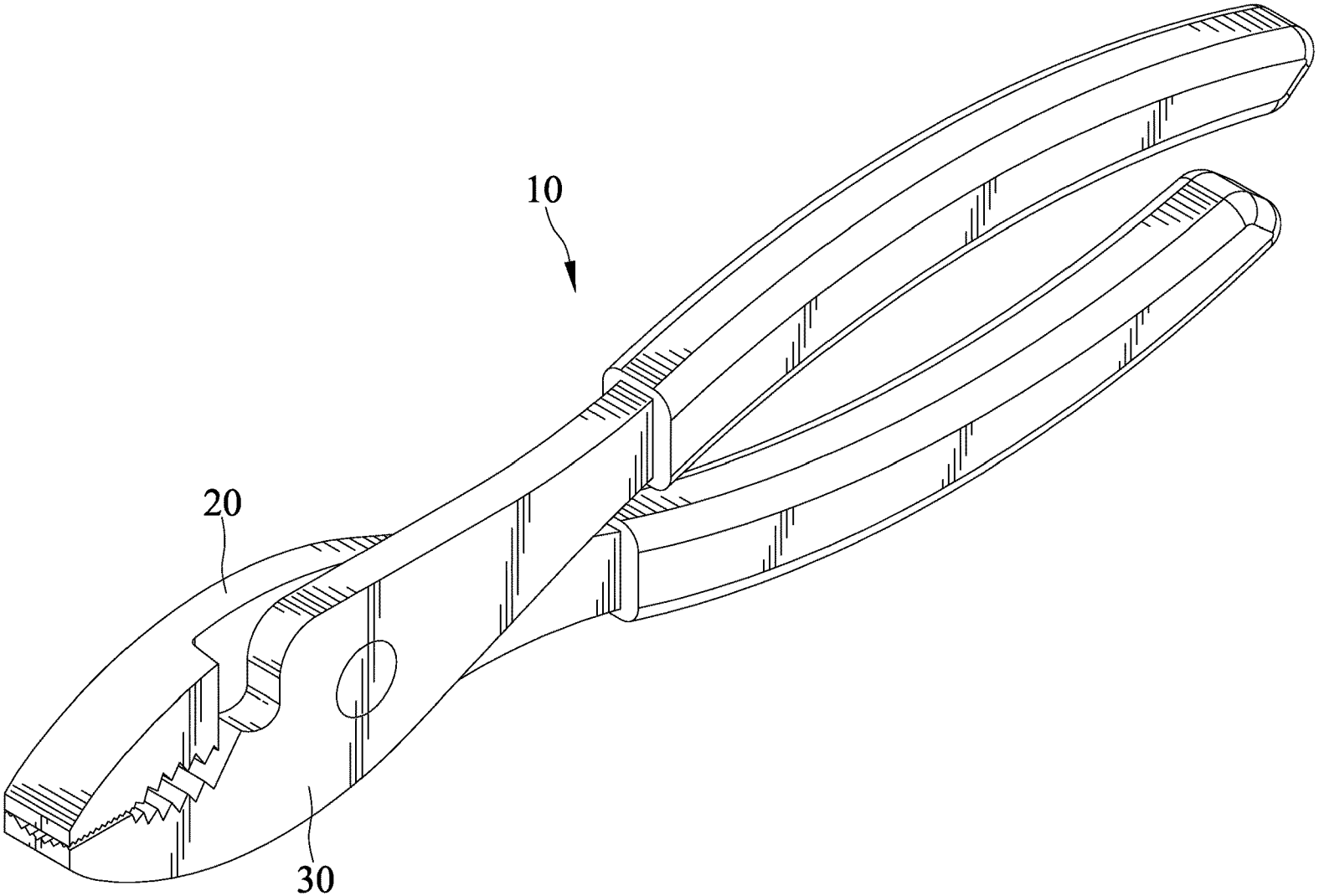
FIG. 1 is a perspective view of a pair of pliers in accordance with a first embodiment of the present invention.
Figure 2:
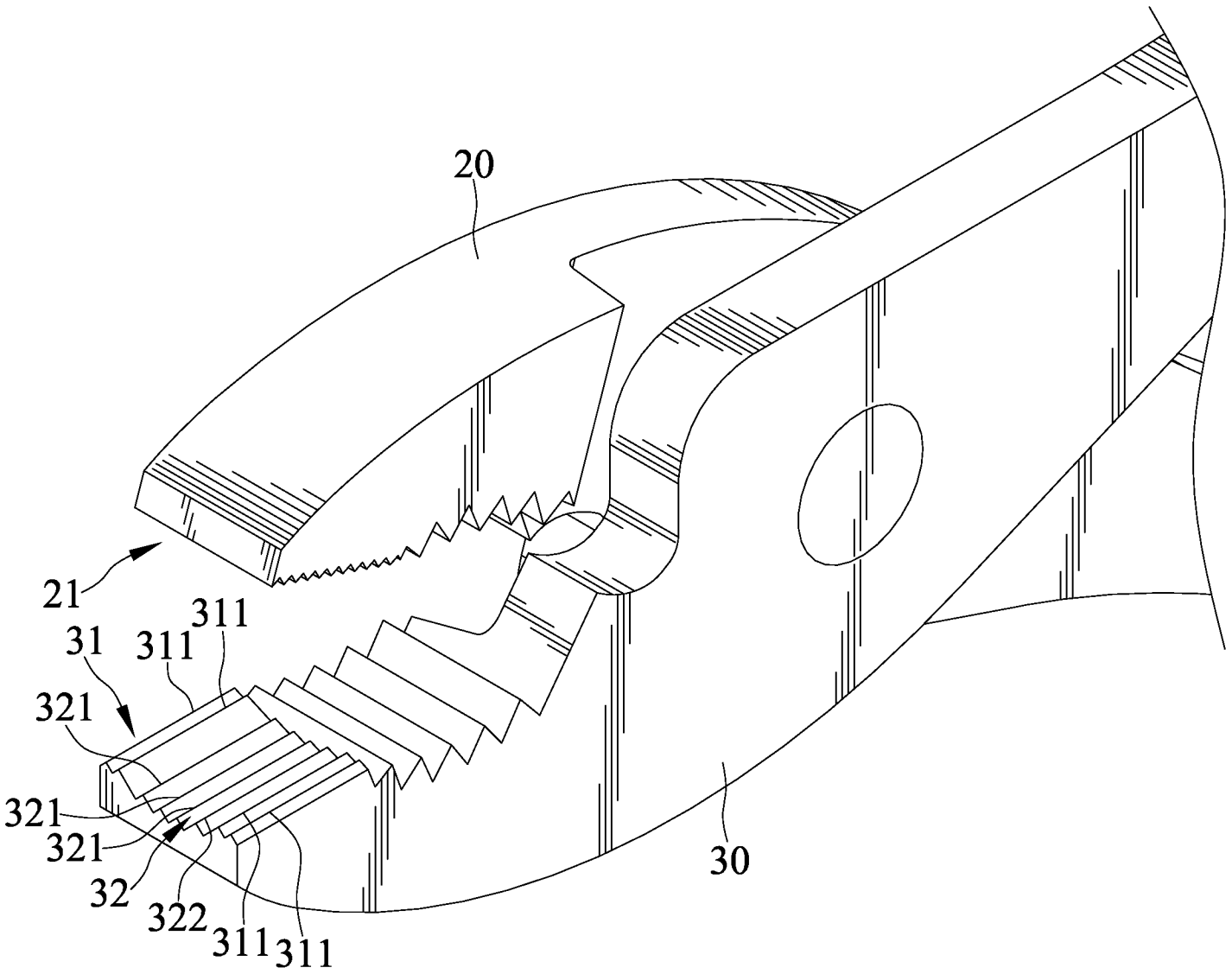
FIG. 2 is a partial, enlarged perspective view of the pair of pliers of FIG. 1.
Figure 3:
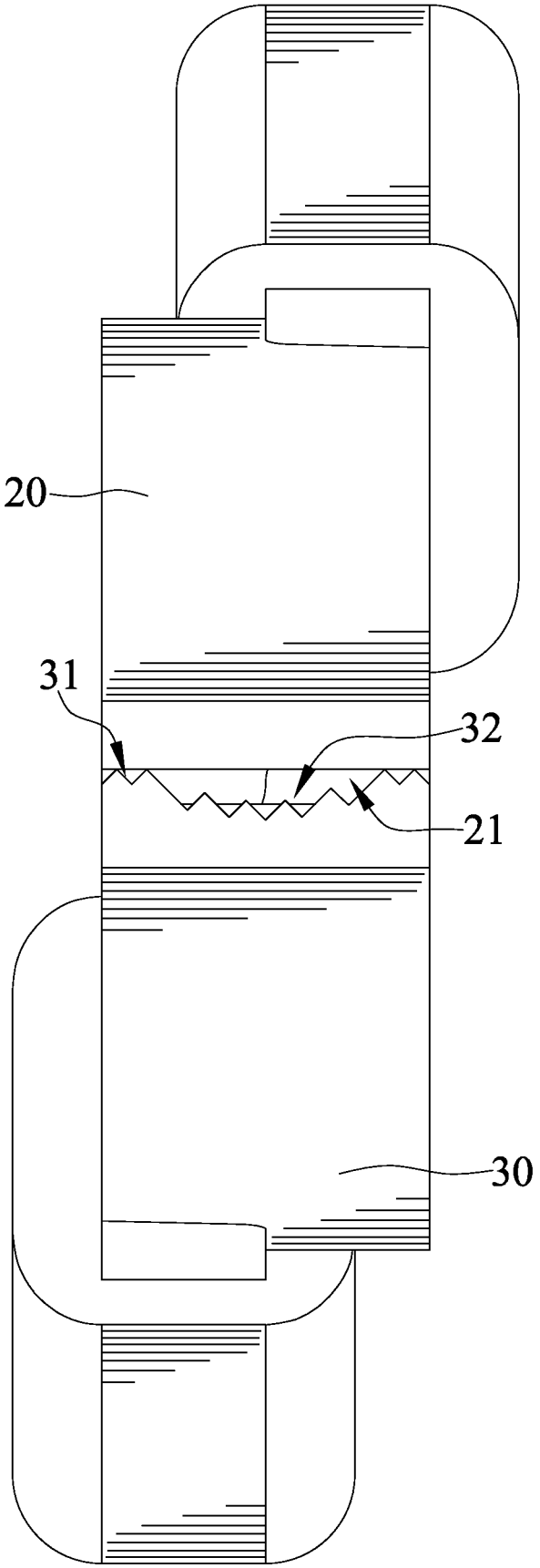
FIG. 3 is a front view of the pair of pliers of FIG. 1.
Figure 4:
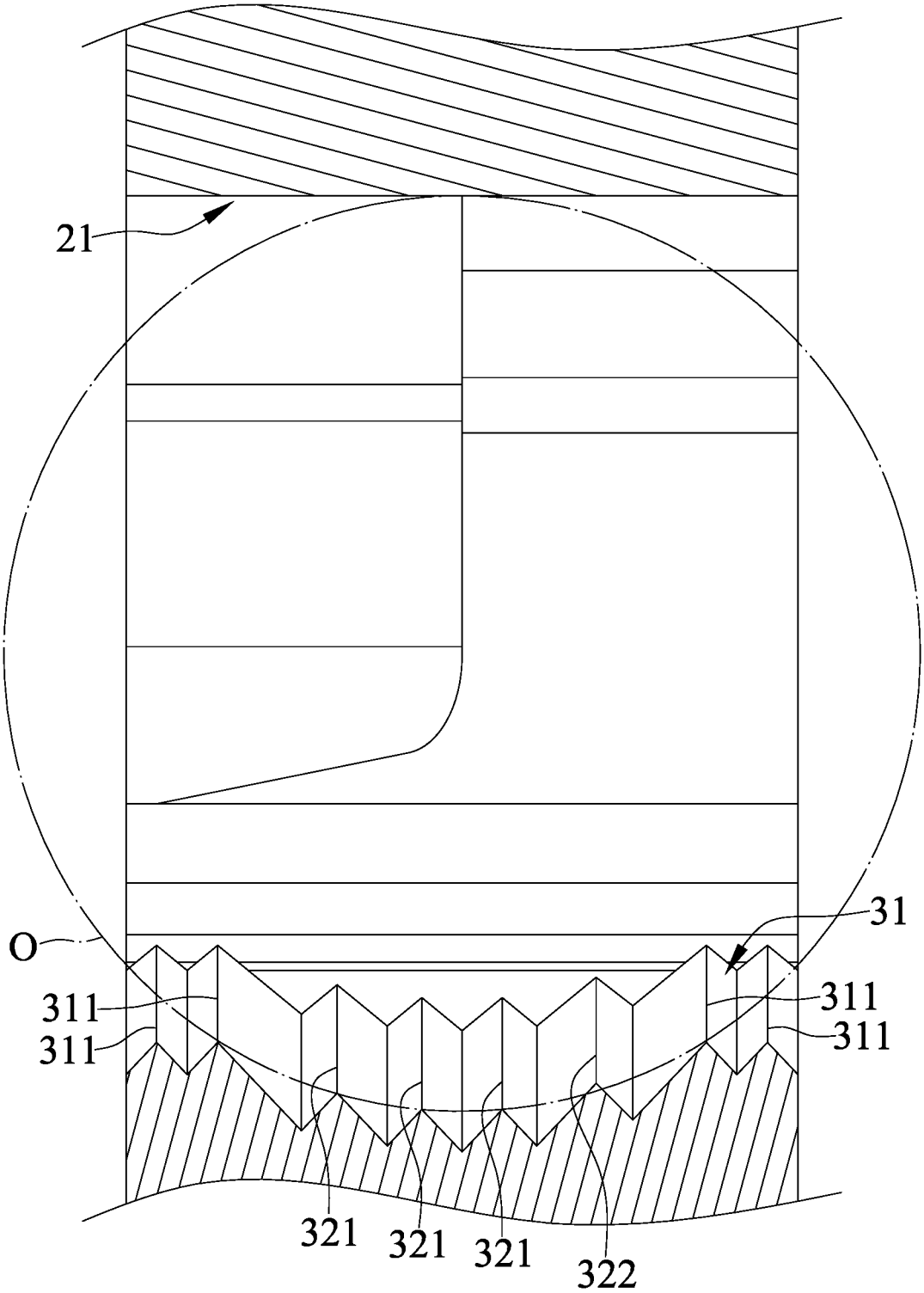
FIG. 4 is a cross-sectional view of a working end of the pair of pliers of FIG. 1.

FIGS. 1 through 5 show a pair of pliers 10 in accordance with a first embodiment of the present invention. The pair of pliers 10 includes a first clamping member 20 and a second clamping member 30 pivotally connected to the first clamping member 20. Front ends of the first and second clamping members 20 and 30 respectively include first and second clamping side 21 and 31 for clamping an object therebetween. The first and second clamping sides 21 and 31 extend in longitudinal directions along longitudinal directions of the respective first and second clamping members 20 and 30. The first and second clamping sides 21 and 31 are disposed adjacent to each other and face oppositely.

The first clamping side 21 has a first clamping portion corresponding to and facing the first clamping portion of the second clamping side 31. The first clamping portion of the first clamping side 21 has opposite first and second sides extending transversely to the longitudinal direction of the first clamping side 21. The first clamping portion of the first clamping side 21 has a serrated face which includes a plurality of teeth 211. Tips of the plurality of teeth 211 of the first clamping portion of the first clamping side 21 extend longitudinally in a direction substantially parallel to the first and second sides of the first clamping portion of the first clamping side 21. The plurality of teeth 211 of the first clamping portion of the first clamping side 21 has equal depths.

The second clamping side 31 has a first clamping portion which defines a clamping recess 32. The clamping recess 32 has opposite first and second sides extending transversely to the longitudinal direction of the second clamping side 31. The clamping recess 32 has a serrated bottom side. The serrated bottom side includes a first high tooth 322 and at least one tooth 321. In the embodiment, the at least one tooth 321 includes a plurality of teeth. The first high tooth 322 has a greater depth than the at least one tooth 321. Tips of the first high tooth 322 and the at least one tooth 321 extend longitudinally between the first and second sides of the clamping recess 32.

The at least one tooth 321 has a projection on a plane. The tip of the plurality of teeth of the least one tooth 321 projected on the plane includes a point disposed on a circumference of a reference circle O which has a center located between the first and second clamping sides 21 and 31. The tip of the first high tooth 322 projected on the plane includes a point disposed within the circumference of the reference circle O.

The first clamping portion of the second clamping side 31 includes two serrated faces disposed separately and the clamping recess 32 is disposed between the two serrated faces. The two serrated faces each include first and second sides and a plurality of teeth 311 disposed therebetween. The first sides of the two serrated faces are contiguous to the first side of the clamping recess 32. The second sides of the two serrated faces are contiguous to the second side of the clamping recess 32. Tips of the plurality of teeth 311 of the two serrated faces extend longitudinally between the first and second sides of the two serrated faces. The tips of the two serrated faces, the first high tooth 322, and the at least one tooth 321 are parallel to one another.

The two serrated faces each include first and second sides and a plurality of teeth 311 disposed therebetween. The first sides of the two serrated faces are contiguous to the first side of the clamping recess. The second sides of the two serrated faces are contiguous to the second side of the clamping recess. Tips of the plurality of teeth 311 of the two serrated faces extend longitudinally in a direction substantially parallel to the first and second sides of the two serrated faces.

Figure 5:
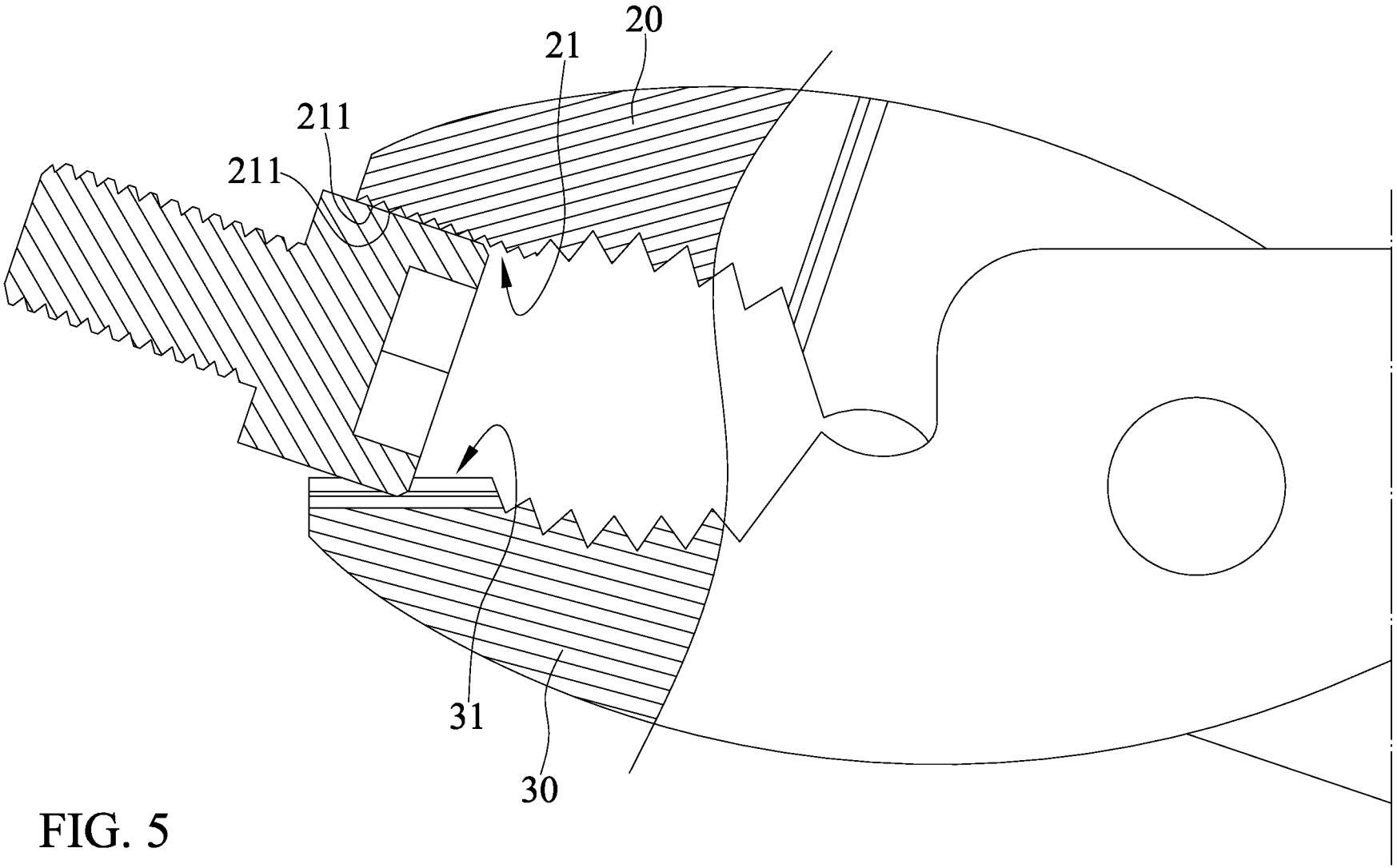
FIG. 5 is a partial, cross-sectional view showing the pair of pliers of FIG. 1 gripping an object.
Figure 6:
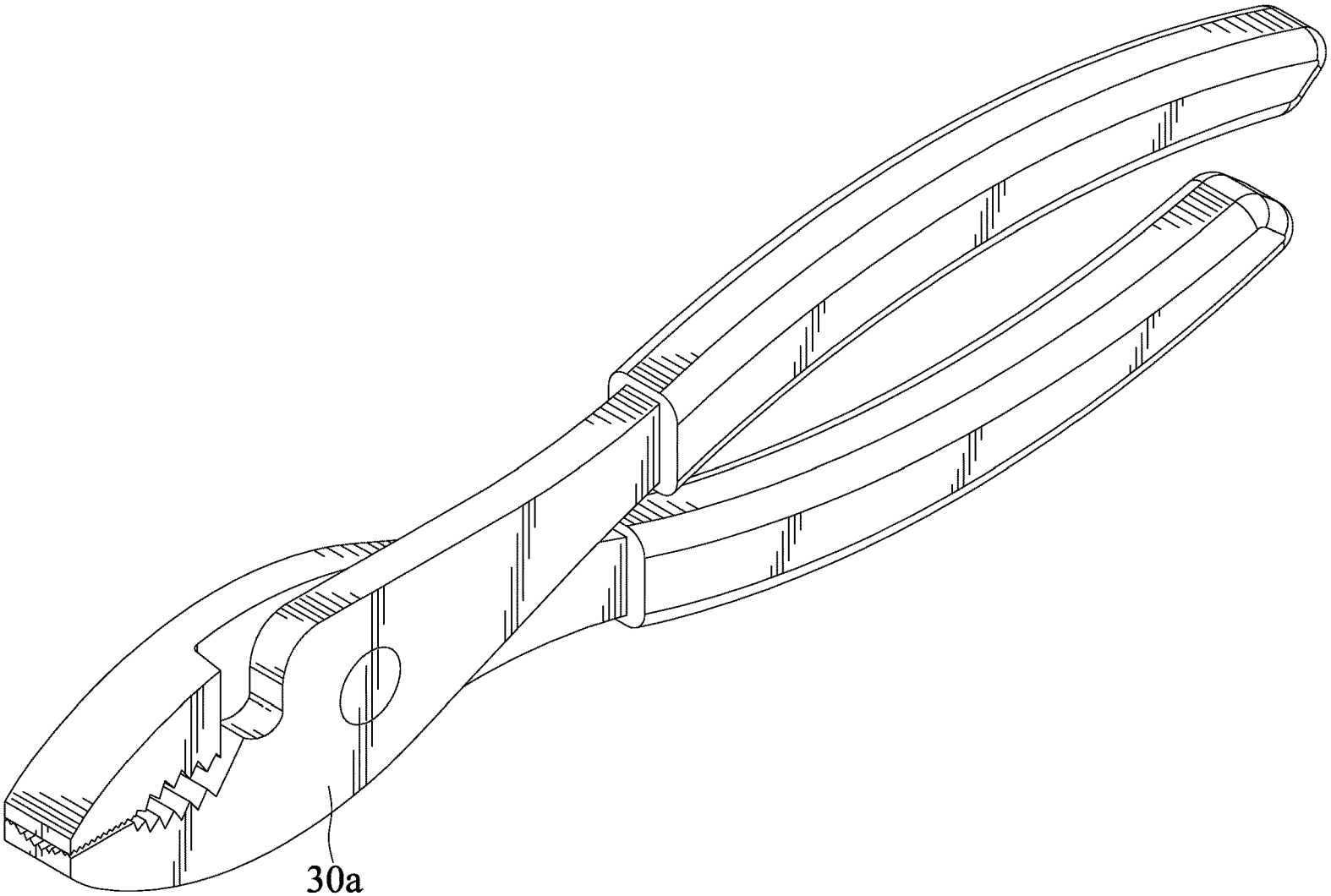
FIG. 6 is a perspective view of a pair of pliers in accordance with a second embodiment of the present invention.
Figure 7:
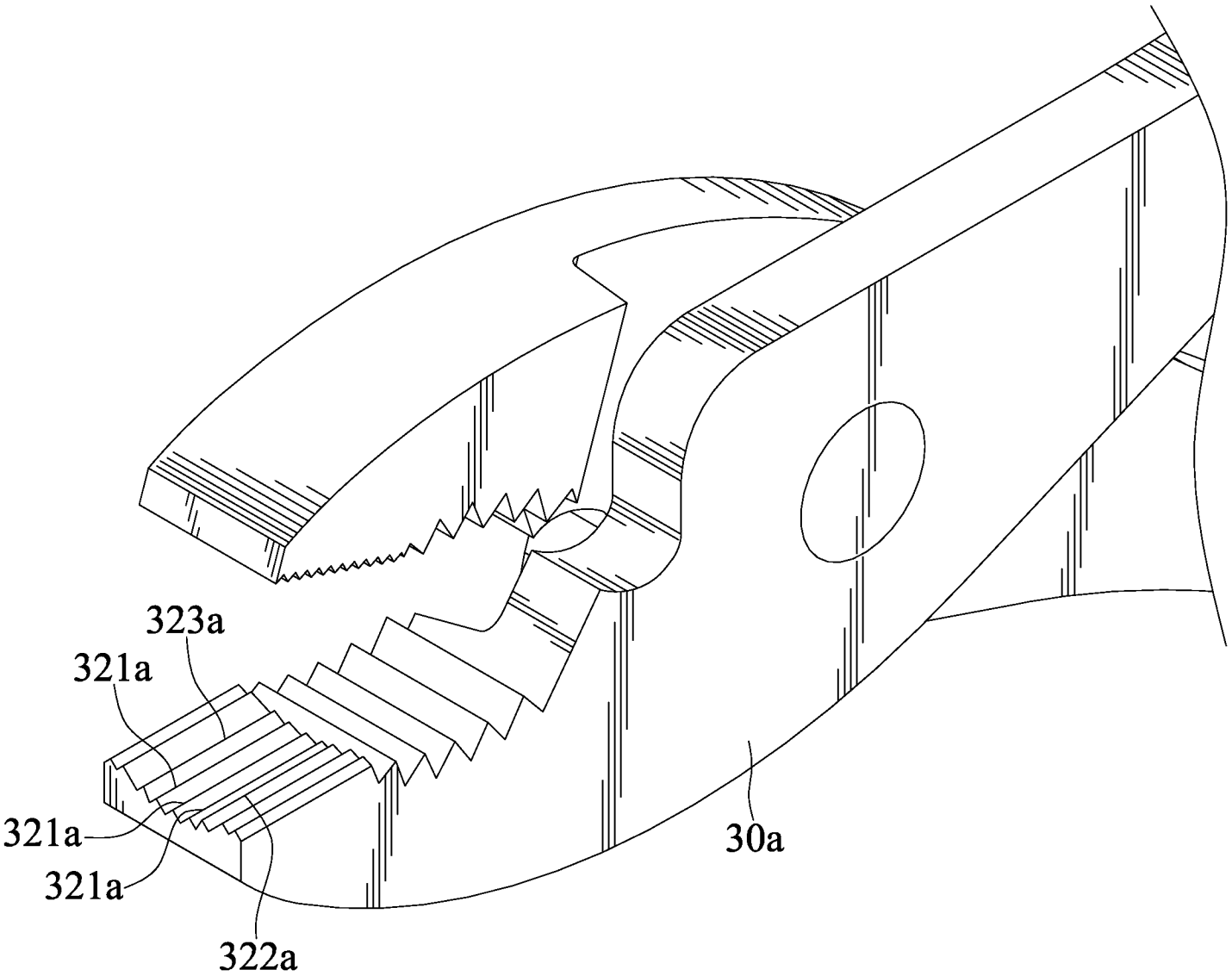
FIG. 7 is a partial, enlarged perspective view of the pair of pliers of FIG. 6.
Figure 8:
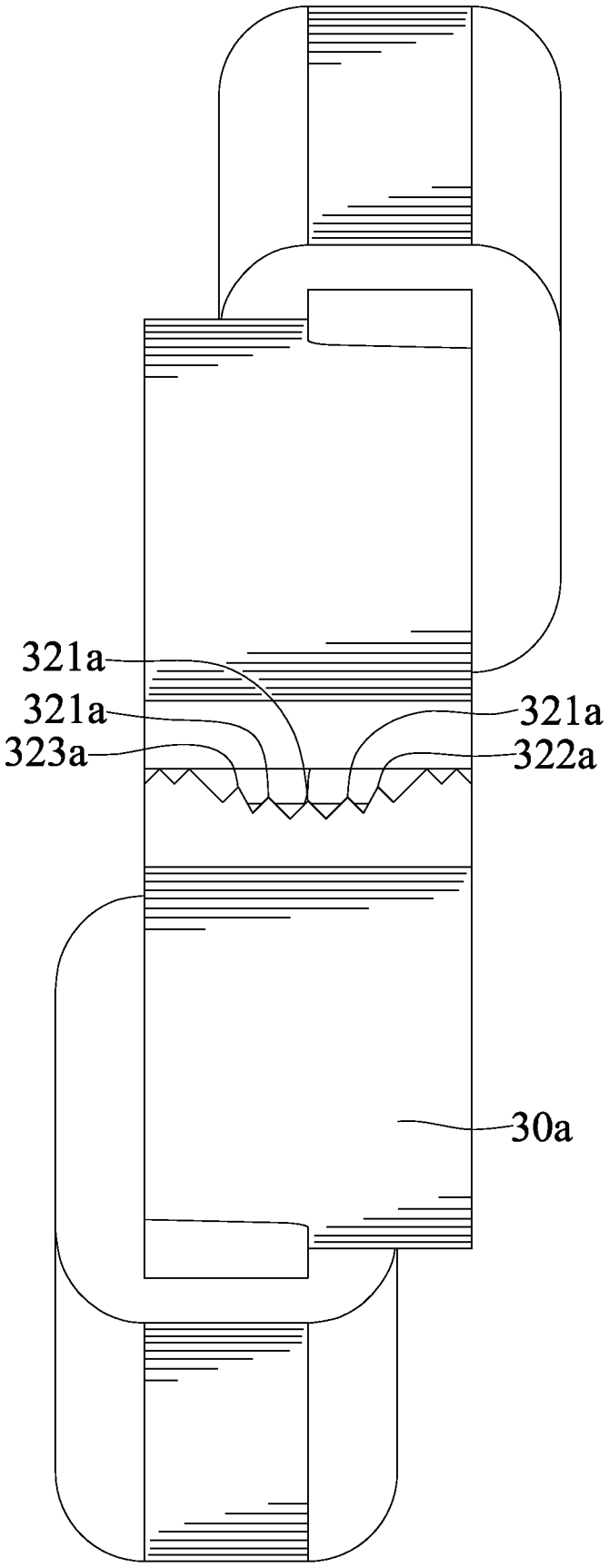
FIG. 8 is a front view of the pair of pliers of FIG. 6.
Figure 9:
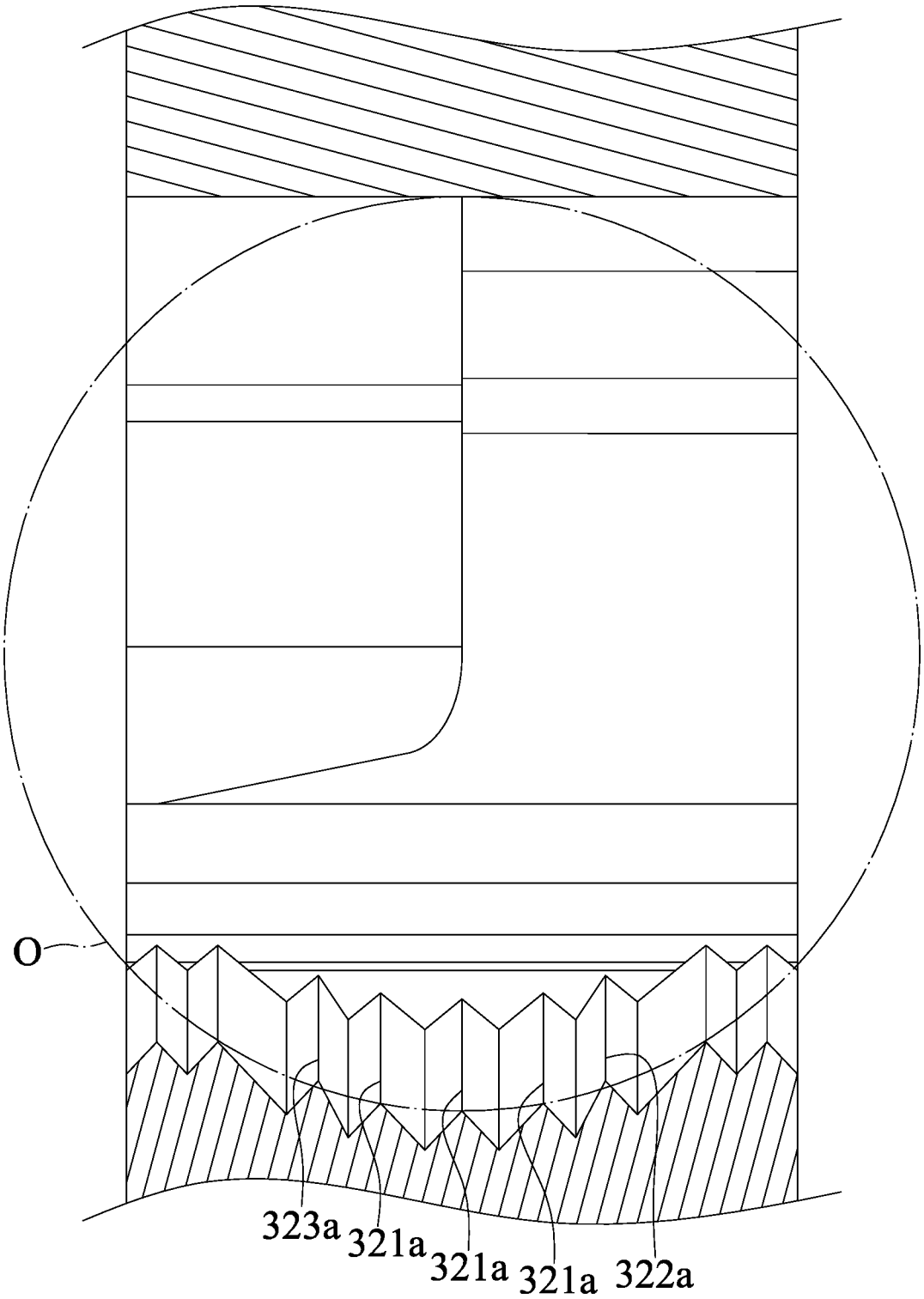
FIG. 9 is a cross-sectional view of a working end of the pair of pliers of FIG. 6.

FIG. 5 shows the pair of pliers 10 clamping an object. In the embodiment, the object is a stripped bolt. The object is clamped by the clamping sides of respective first and second clamping members 20 and 30. Particularly, the object is clamped by the first clamping portions of the respective of the clamping sides. Further, the serrated bottom side of the clamping recess 32 receives the object and the first high tooth 322 is configured to prevent the plurality of teeth 311 from slipping on the object.

In addition, each of the first and second clamping members 20 and 30 includes a second clamping portion disposed next to its first clamping portion for clamping an object. The second clamping portions extend longitudinally along the longitudinal directions of the respective first and second clamping sides. The second clamping portions face oppositely. Each second clamping portion is an arcuate serrated face.

FIGS. 6 through 9 show a pair of pliers in accordance with a second embodiment of the present invention, and the same numbers are used to correlate similar components of the first embodiment, but bearing a letter a. The second embodiment includes a clamping member 30*a*. A serrated bottom side of a clamping recess includes a first high tooth 322*a* and at least one tooth 321*a*. In the embodiment, the at least one tooth 321*a* includes a plurality of teeth. The first high tooth 322*a* has a greater depth than the at least one tooth 321*a*. Tips of the first high tooth 322*a* and the at least one tooth 321*a* extend longitudinally between the first and second sides of the clamping recess. The at least one tooth 321*a* has a projection on a plane. The tip of the plurality of teeth of the least one tooth 321*a* projected on the plane includes a point disposed on a circumference of a reference circle O. The tip of the first high tooth 322*a* projected on the plane includes a point disposed within the circumference of the reference circle O. A first clamping portion of a second clamping side 31 includes two serrated faces disposed separately and a clamping recess is disposed between the two serrated faces. The tips of the teeth of the two serrated faces, the first high tooth 322*a*, and the at least one tooth 321*a* are parallel to one another.

The second embodiment is similar to the first embodiment except that the serrated bottom side of the clamping recess further includes a second high tooth 323*a*. The second high tooth 323*a* has a projection on the plane. A tip of the second high tooth 323*a* projected on the plane includes a point disposed within the circumference of the reference circle O. The at least one tooth 321*a* is disposed between the first high tooth 322*a* and the second high tooth 323*a*.

Figure 10:
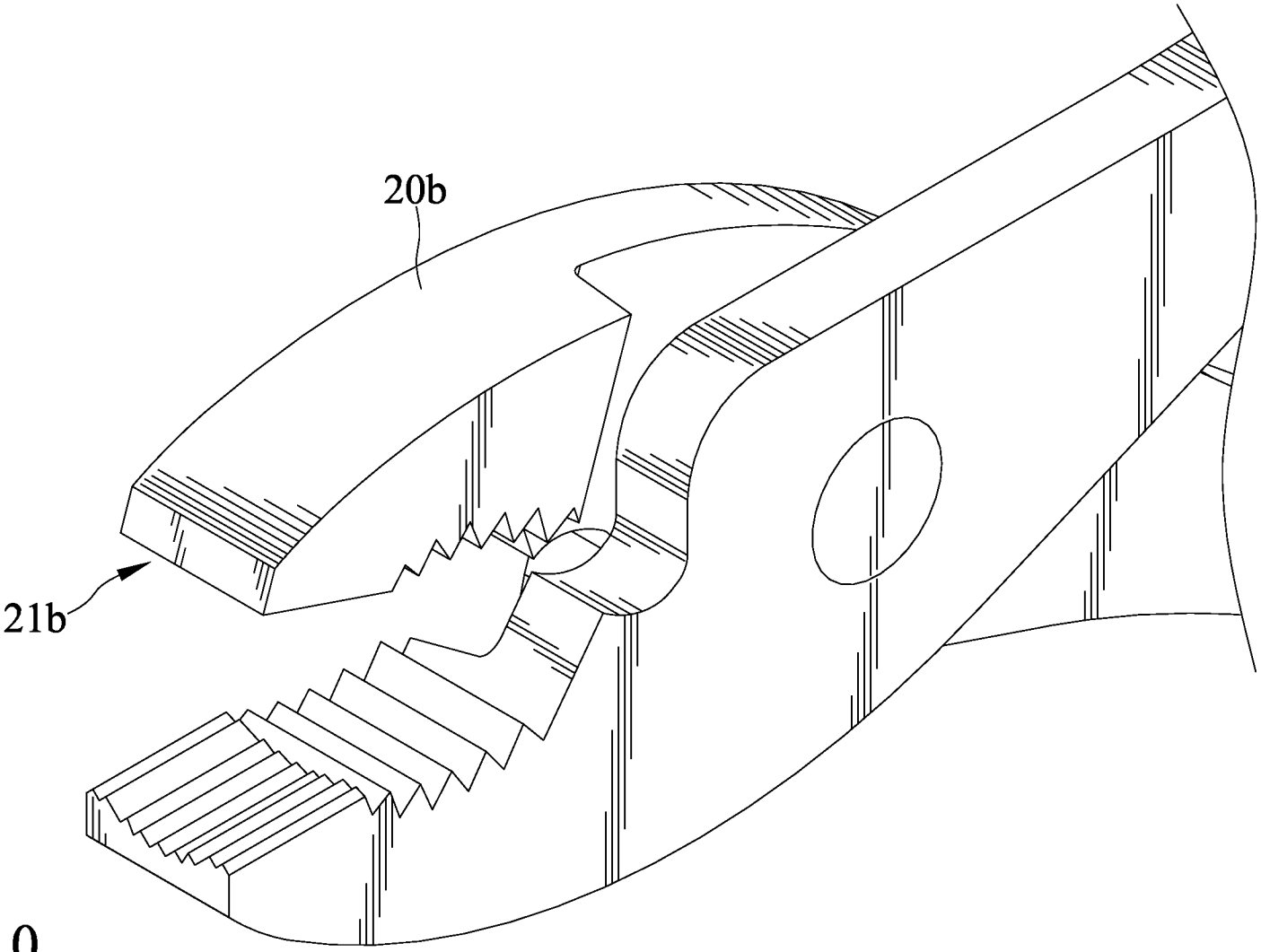
FIG. 10 is a perspective view of a working end of a pair of pliers in accordance with a third embodiment of the present invention.
Figure 11:
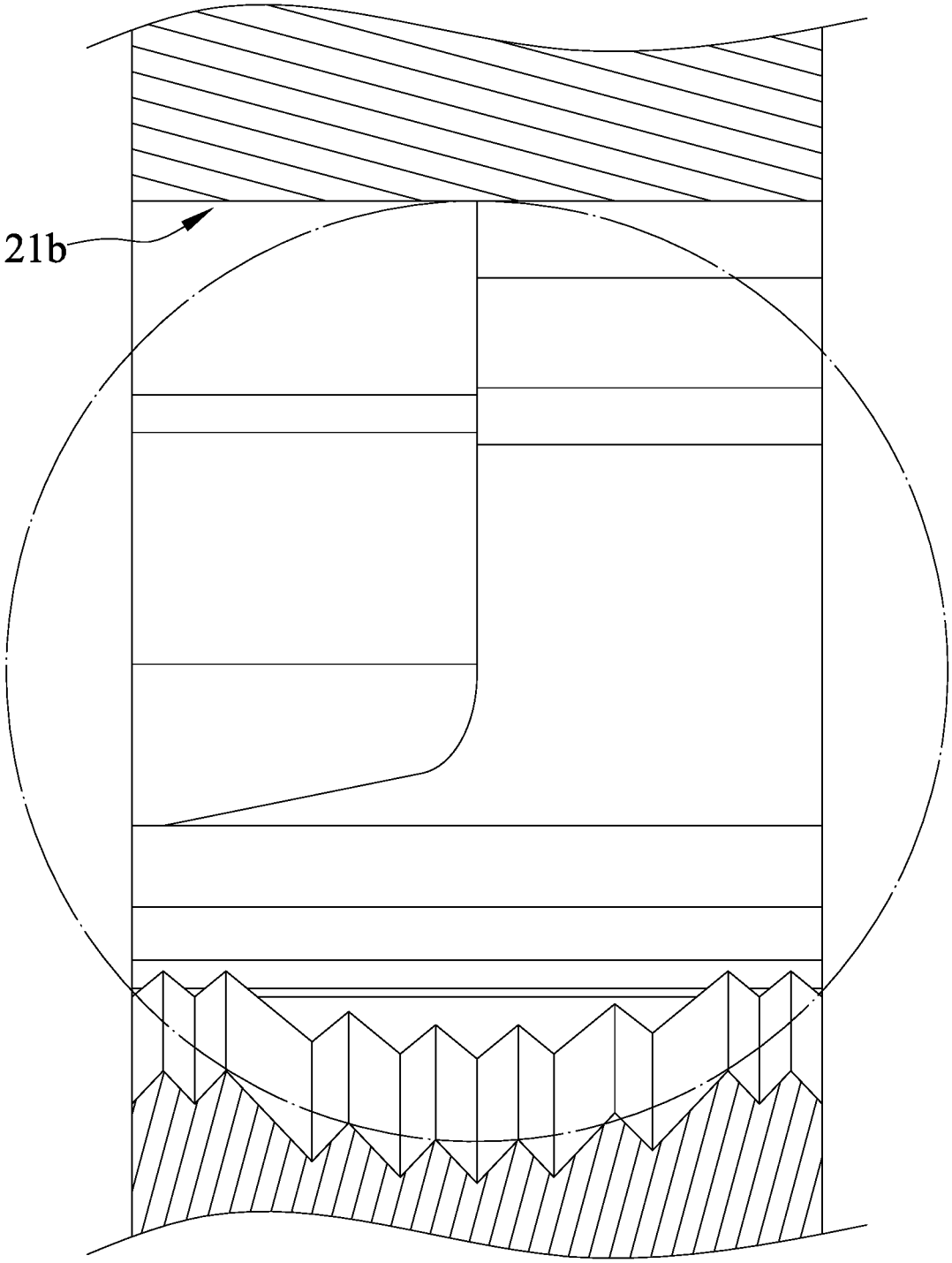
FIG. 11 is a cross-sectional view of the working end of the pair of pliers of FIG. 10.

FIGS. 10 and 11 show a pair of pliers in accordance with a third embodiment of the present invention, and the same numbers are used to correlate similar components of the first embodiment, but bearing a letter b. The third embodiment includes a first clamping member 20*b*. Front end of the first clamping member 20*b* includes a first clamping side 21*b*. The first clamping side 21*b* extends in longitudinal direction along a longitudinal direction of the first clamping member 20*b*. The first clamping side 21*b* has a first clamping portion corresponding to and facing a clamping portion of a second clamping side. The third embodiment is similar to the first embodiment except that the first clamping portion of the first clamping side 21*b* is a flat face.

Figure 12:
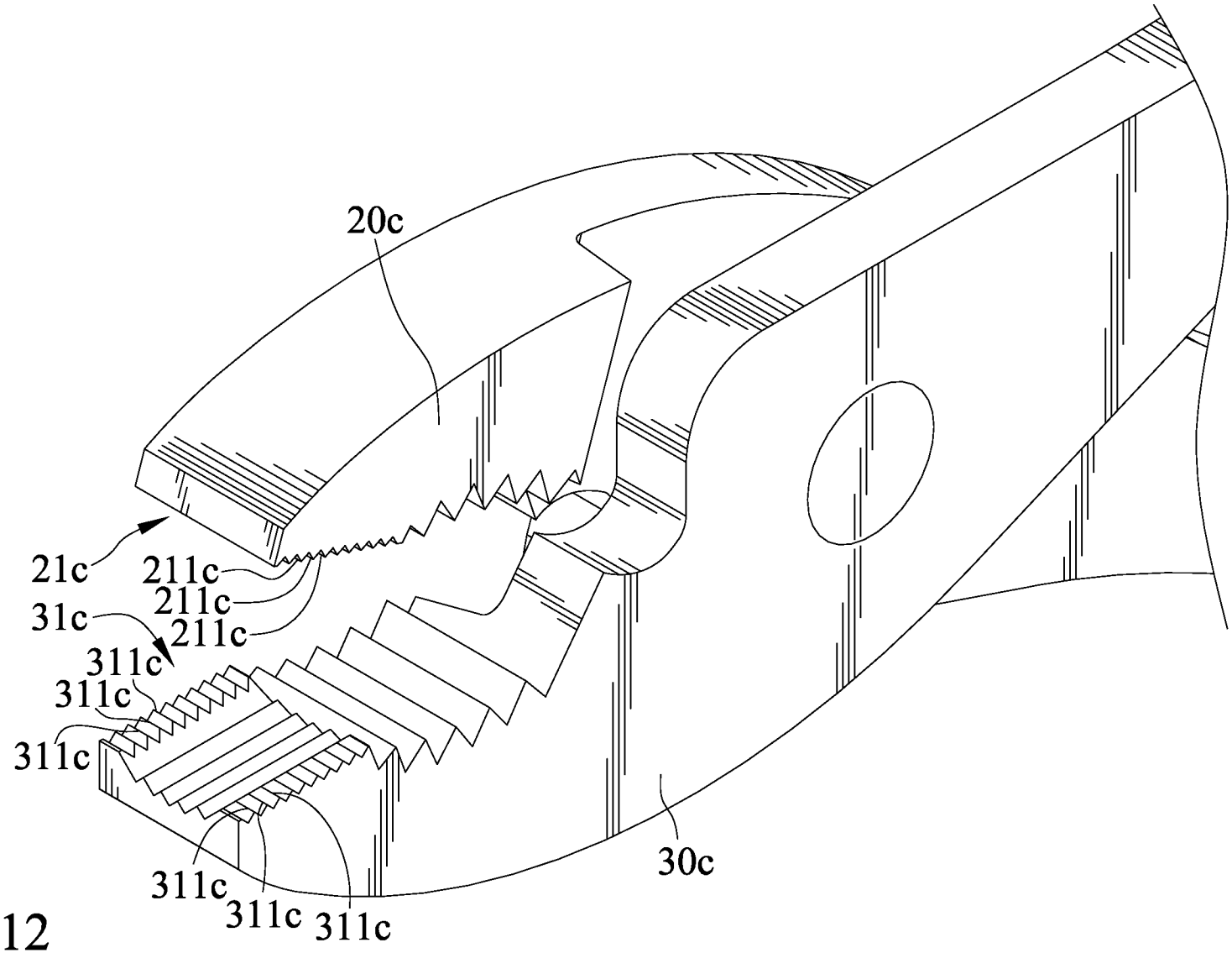
FIG. 12 is a partial, perspective view of a working end of a pair of pliers in accordance with a fourth embodiment of the present invention.

FIG. 12 shows a pair of pliers in accordance with a fourth embodiment of the present invention, and the same numbers are used to correlate similar components of the first embodiment, but bearing a letter c. The fourth embodiment includes a first clamping member 20*c* and a second clamping member 30*c* pivotally connected to the first clamping member 20*c*. Front ends of the first and second clamping members 20*c* and 30*c* respectively include first and second clamping side 21*c* and 31*c* for clamping an object therebetween. The first and second clamping sides 21*c* and 31*c* are disposed adjacent to each other and face oppositely. The first clamping side 21*c* has a first clamping portion corresponding to and facing the first clamping portion of the second clamping side 31*c*. The first clamping portion of the first clamping side 21*c* has opposite first and second sides extending transversely to the longitudinal direction of the first clamping side 21*c*. The first clamping portion of the first clamping side 21*c* has a serrated face which includes a plurality of teeth 211*c*. Tips of the plurality of teeth 211*c* of the first clamping portion of the first clamping side 21*c* extend longitudinally in a direction substantially parallel to the first and second sides of the first clamping portion of the first clamping side 21*c*. The plurality of teeth 211*c* of the first clamping portion of the first clamping side 21*c* has equal depths. The first clamping portion of the second clamping side 31*c* includes two serrated faces disposed separately and a clamping recess is disposed between the two serrated faces. A first clamping portion of a second clamping side 31 includes two serrated faces disposed separately and a clamping recess is disposed between the two serrated faces. The two serrated faces each include first and second sides and a plurality of teeth 311*c* disposed therebetween. The first sides of the two serrated faces are contiguous to the first side of the clamping recess 32. The second sides of the two serrated faces are contiguous to the second side of the clamping recess. The fourth embodiment is similar to the first embodiment except that tips of the plurality of teeth 311 of the two serrated faces extend longitudinally in a direction substantially parallel to the first and second sides of the two serrated faces. The plurality of teeth 311*c* of the two serrated faces is adapted to mesh with the plurality of teeth 211*c* of the first clamping portion of the first clamping side.

Figure 13:
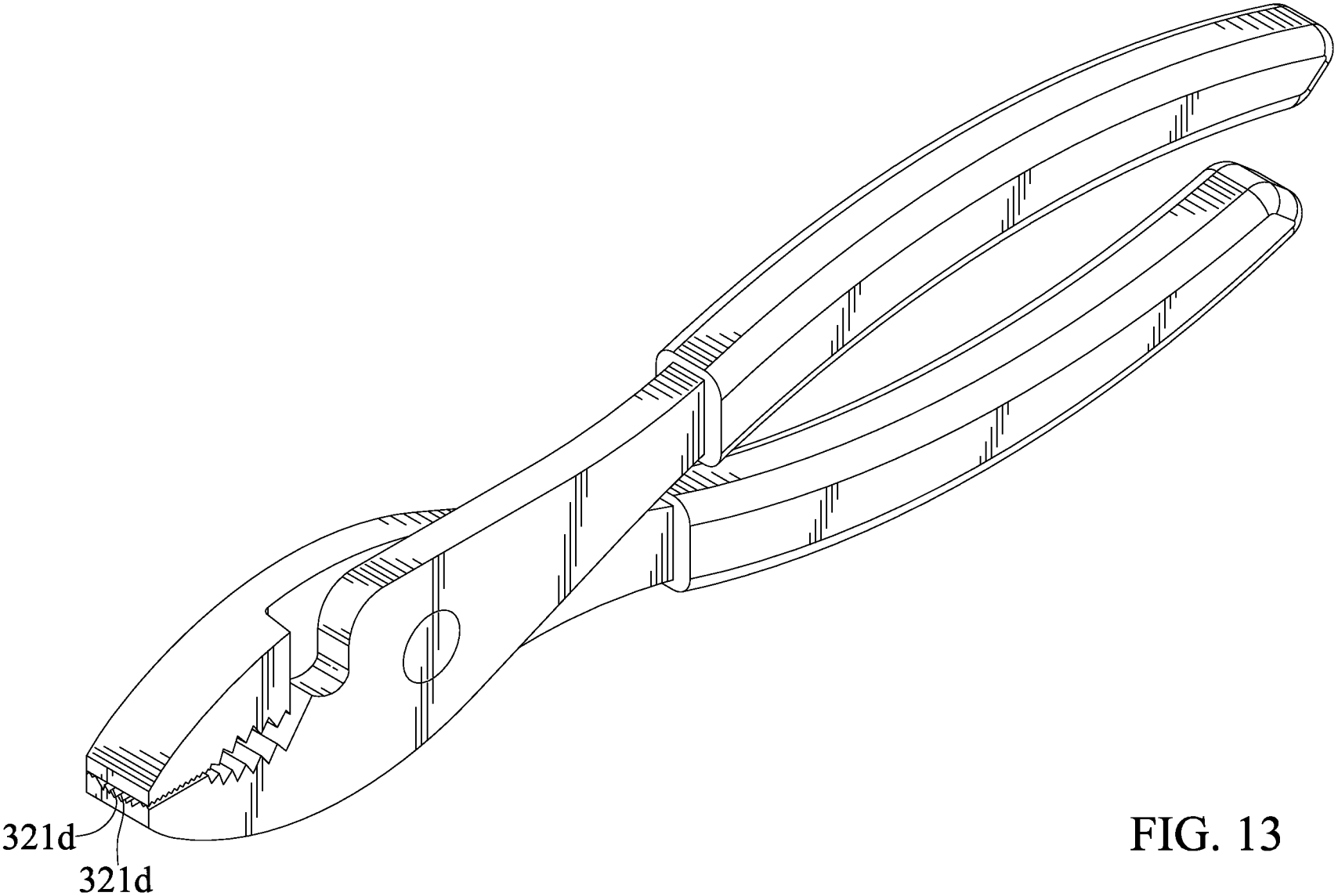
FIG. 13 is a perspective view of a pair of pliers in accordance with a fifth embodiment of the present invention.
Figure 14:
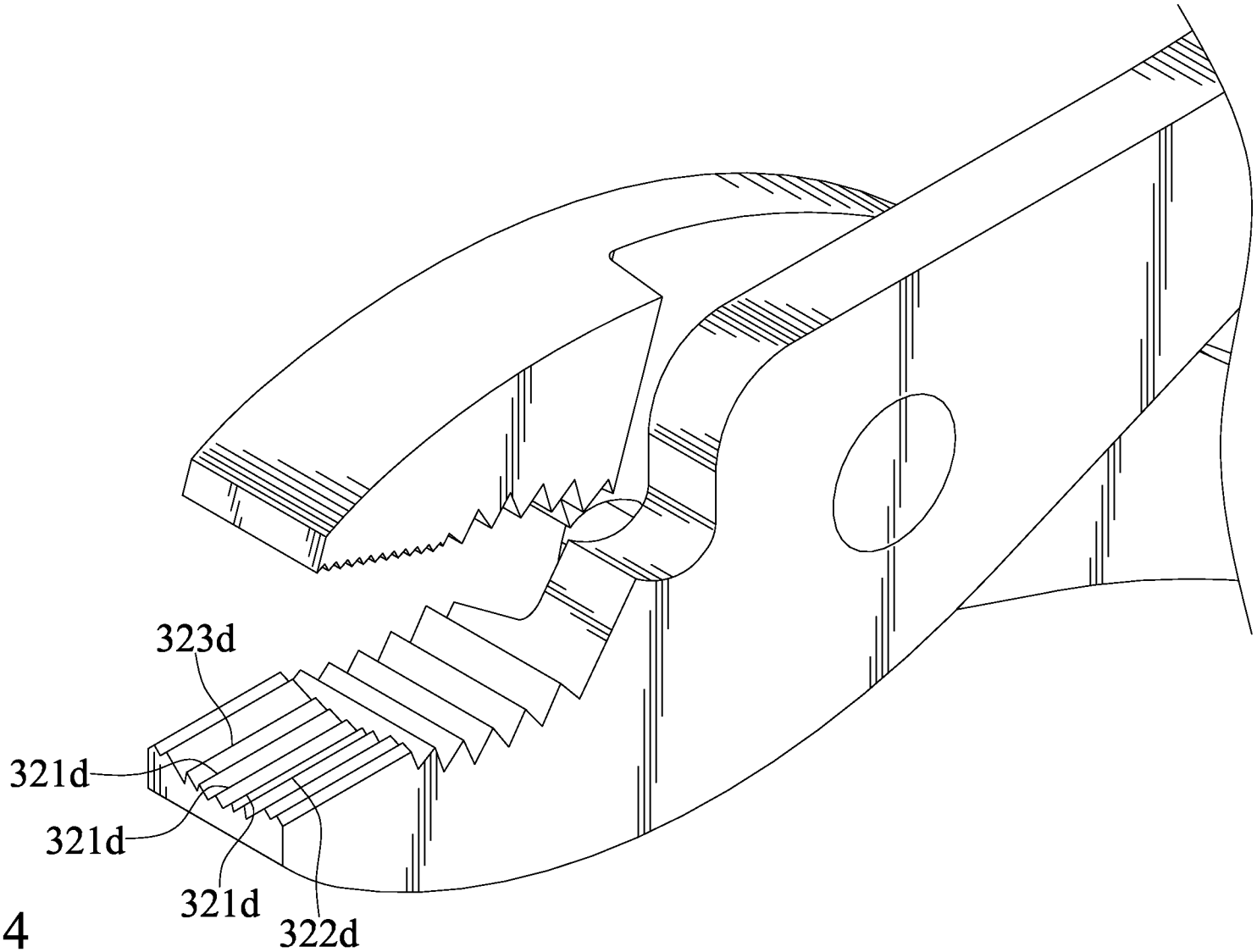
FIG. 14 is a partial, enlarged perspective view of the pair of pliers of FIG. 13.
Figure 15:
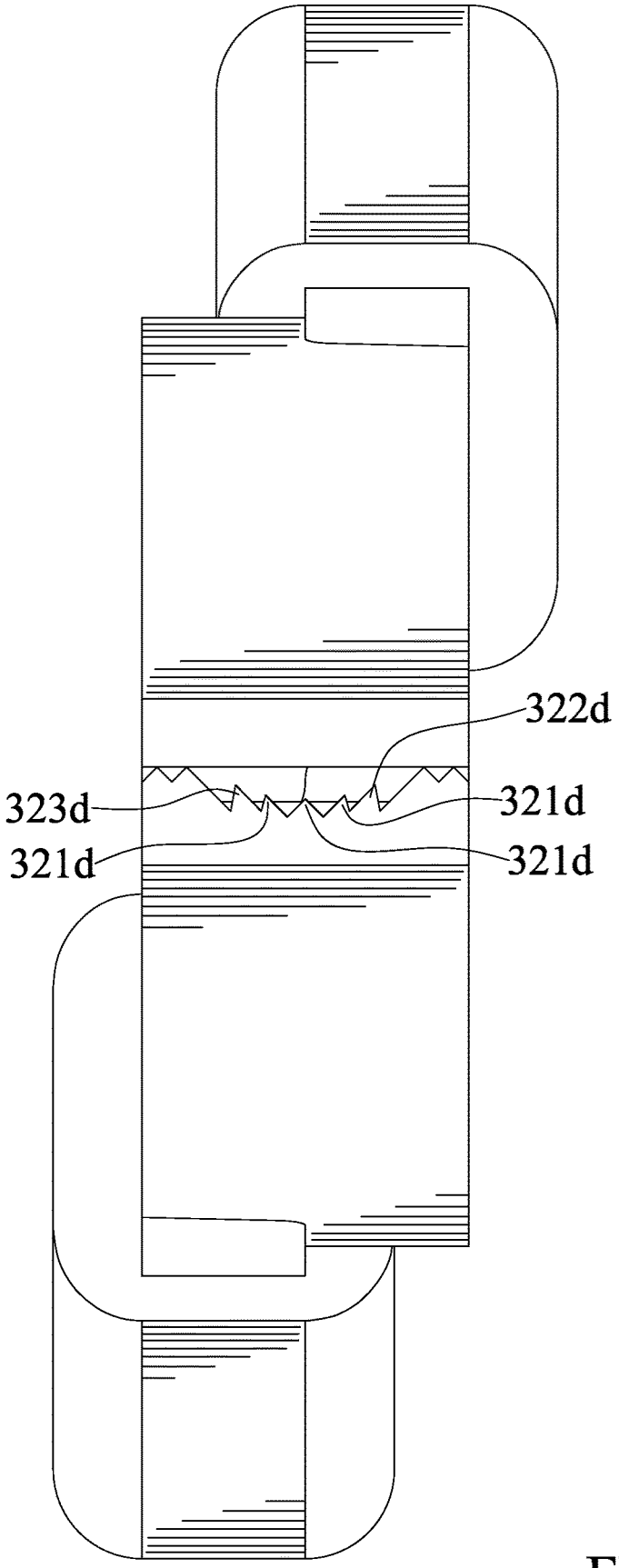
FIG. 15 is a front view of the pair of pliers of FIG. 13.
Figure 16:
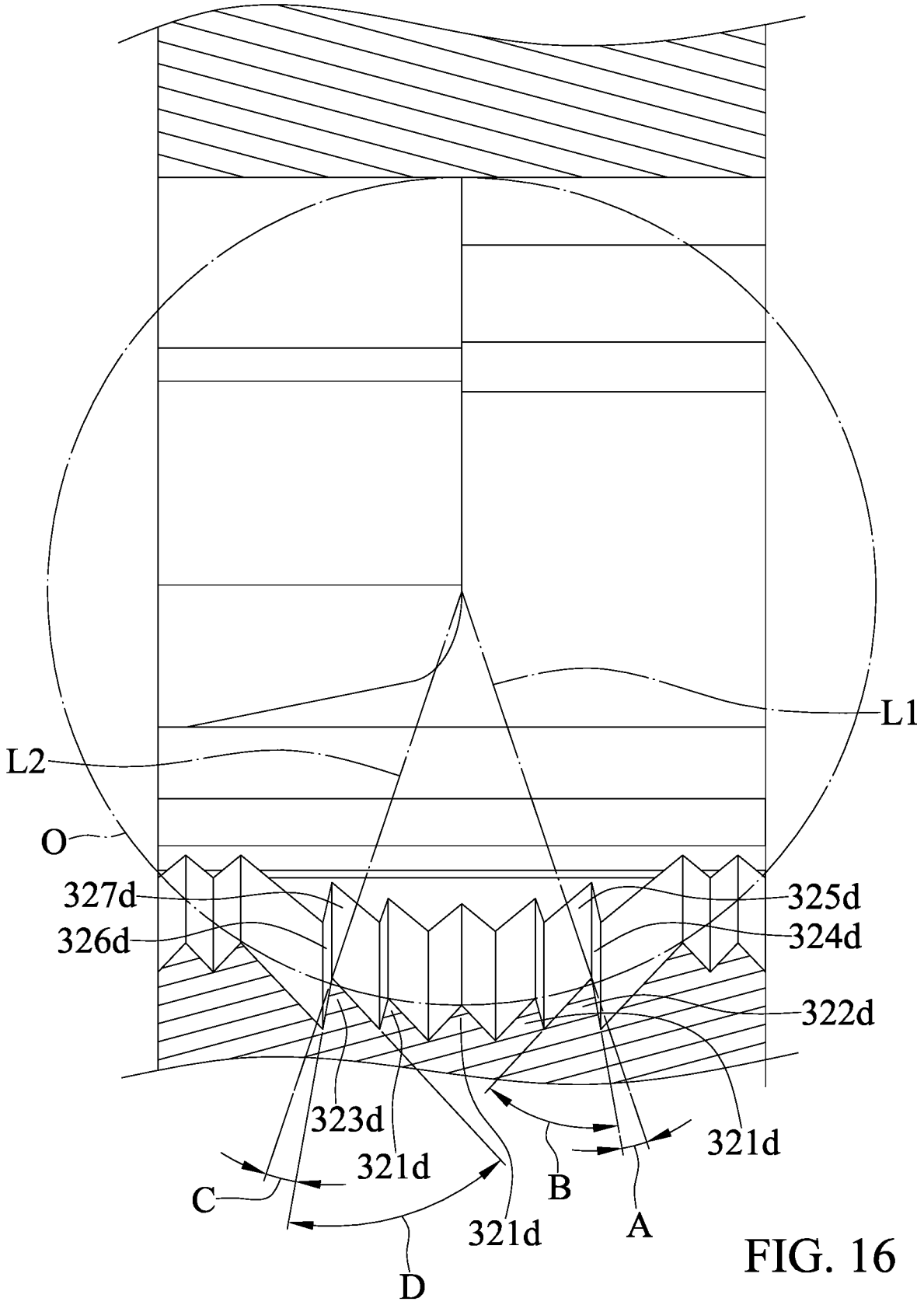
FIG. 16 is a cross-sectional view of the working end of the pair of pliers of FIG. 13.

FIGS. 13 through 15 show a pair of pliers in accordance with a fifth embodiment of the present invention, and the same numbers are used to correlate similar components of the first embodiment, but bearing a letter d. A serrated bottom side of a clamping recess includes a first high tooth 322*d* and at least one tooth 321*d*. In the embodiment, the at least one tooth 321*d* includes a plurality of teeth. The first high tooth 322*d* has a greater depth than the at least one tooth 321*d*. Tips of the first high tooth 322*d* and the at least one tooth 321*d* extend longitudinally between the first and second sides of the clamping recess. The at least one tooth 321*d* has a projection on a plane. The tip of the plurality of teeth of the least one tooth 321*d* projected on the plane includes a point disposed on a circumference of a reference circle O. The tip of the first high tooth 322*d* projected on the plane includes a point disposed within the circumference of the reference circle O. The first high tooth 322*d* has two faces 324*d* and 325*d* being contiguous to and extending on opposite sides of its tip. A second high tooth 323*d* has a projection on the plane. A tip of the second high tooth 323*d* projected on the plane includes a point disposed within the circumference of the reference circle O. The second high tooth 323*d* has two faces 326*d* and 327*d* being contiguous to and extending on opposite sides of its tip. The at least one tooth 321*d* is disposed between the first high tooth 322*d* and the second high tooth 323*d*. A first clamping portion of a second clamping side includes two serrated faces disposed separately and a clamping recess is disposed between the two serrated faces. The tips of teeth of the two serrated faces, the first high tooth 322*d*, and the at least one tooth 321*d* are parallel to one another.

The fifth embodiment is similar to the second embodiment except that the two faces 324*d* and 325*d* projected on the plane includes a first line and a second line on a same side of a first reference line L1 which extends on the plane from the center of the reference circle O to the tip of the first high tooth 322*d*. The two faces 326*d* and 327*d* of the second high tooth 323*d* are on a same side about a second reference line L2 which extends from the center of the reference circle O to the top of the second high tooth 322*d*. The first and second high teeth 322*d* and 323*d* are unsymmetrical. The first and second lines of the first high tooth 322*d* have different lengths. The first and second lines of the second high tooth 323*d* have different lengths. The first line of the first high tooth 322*d* is inclined from the first reference line L1 at a first angle A which is greater than 5 degrees and less than 15 degrees. The second line of the first high tooth 322*d* is inclined from the first reference line L1 at a second angle B which is greater than 45 degrees and less than 75 degrees. The first line of the second high tooth 323*d* is inclined from the second reference line L2 at a first angle C which is greater than 5 degrees and less than 15 degrees. The second line of the second high tooth 323*d* is inclined from the second reference line L2 at a second angle D which is greater than 45 degrees and less than 75 degrees. In view of the forgoing, the pair of pliers 10 is adapted to clamp an object when applying a large torque to turn the object because the object is clamped by the clamping sides of respective first and second clamping members 20, 20*b*, 20*c*, 30, 30*a*, and 30*c*. Particularly, the object is clamped by the first clamping portions of the respective of the clamping sides. Further, the serrated bottom side of the clamping recess 32 receives the object and the high teeth 322, 322*a*, 322*d*, 323*a*, and 323*d* are configured to prevent the plurality of teeth 311 from slipping on the object. In addition, with the specific unsymmetrical tooth design as set forth, as the object is turned more, the harder the high teeth 322, 322*a*, 322*d*, 323*a*, and 323*d* push against the object.

The foregoing is merely illustrative of the principles of this invention, and various modifications can be made by those skilled in the art without departing from the scope and spirit of the invention.

What is claimed is:

1. A pair of pliers comprising:

a first clamping member; and a second clamping member pivotally connected to the first clamping member;

wherein front ends of the first and second clamping members respectively include first and second clamping sides for clamping an object therebetween, wherein the first and second clamping sides extend in longitudinal directions along longitudinal directions of the respective first and second clamping members, wherein the first and second clamping sides are disposed adjacent to each other and face oppositely, wherein the second clamping side has a first clamping portion which defines a clamping recess, wherein the clamping recess has opposite first and second sides extending transversely to the longitudinal direction of the second clamping side, wherein the clamping recess has a serrated bottom side, wherein the serrated bottom side includes a first high tooth and at least one tooth, wherein the first high tooth has a greater depth than the at least one tooth, wherein tips of the first high tooth and the at least one tooth extend longitudinally between the first and second sides of the clamping recess, wherein the at least one tooth has a projection on a plane, wherein the tip of the least one tooth projected on the plane includes a point disposed on a circumference of a reference circle which has a center located between the first and second clamping sides, wherein the tip of the first high tooth projected on the plane includes a point disposed within the circumference of the reference circle, wherein the first high tooth has two faces being contiguous to and extending on opposite sides of its tip, and wherein the two faces projected on the plane includes a first line and a second line on a same side of a first reference line which extends on the plane from the center of the reference circle to the tip of the first high tooth.

2. The pair of pliers as claimed in claim 1, wherein the at least one tooth includes a plurality of teeth, and wherein the tips of the plurality of teeth of the at least one tooth projected on the plane includes points disposed on the circumference of the reference circle.

3. The pair of pliers as claimed in claim 1, wherein the serrated bottom side of the clamping recess includes a second high tooth which has a projection on the plane, wherein a tip of the second high tooth projected on the plane includes a point disposed within the circumference of the reference circle.

4. The pair of pliers as claimed in claim 3, wherein the at least one tooth is disposed between the first high tooth and the second high tooth.

5. The pair of pliers as claimed in claim 4, wherein the second high tooth has two faces being contiguous to and extending on opposite sides of its tip, and wherein the two faces of the second high tooth are on a same side about a second reference line which extends from the center of the reference circle to the tip of the second high tooth.

6. The pair of pliers as claimed in claim 5, wherein the first and second high teeth are unsymmetrical, wherein the first and second lines of the first high tooth have different lengths, and wherein the first and second lines of the second high tooth have different lengths.

7. The pair of pliers as claimed in claim 6, wherein the first line of the first high tooth is inclined from the first reference line at a first angle which is greater than 5 degrees and less than 15 degrees, wherein the second line of the first high tooth is inclined from the first reference line at a second angle which is greater than 45 degrees and less than 75 degrees, wherein the first line of the second high tooth is inclined from the second reference line at a first angle which is greater than 5 degrees and less than 15 degrees, wherein the second line of the second high tooth is inclined from the second reference line at a second angle which is greater than 45 degrees and less than 75 degrees.

8. The pair of pliers as claimed in claim 3, wherein the first and second high teeth are unsymmetrical.

9. The pair of pliers as claimed in claim 1, wherein the first clamping side has a first clamping portion corresponding to and facing the first clamping portion of the second clamping side, wherein the first clamping portion of the first clamping side has opposite first and second sides extending transversely to the longitudinal direction of the first clamping side, wherein the first clamping portion of the first clamping side has a serrated face which includes a plurality of teeth, wherein tips of the plurality of teeth of the first clamping portion of the first clamping side extend longitudinally in a direction substantially parallel to the first and second sides of the first clamping portion of the first clamping side.

10. The pair of pliers as claimed in claim 9, wherein the plurality of teeth of the first clamping portion of the first clamping side has equal depths.

11. The pair of pliers as claimed in claim 9, wherein the first clamping portion of the second clamping side includes two serrated faces disposed separately and the clamping recess is disposed between the two serrated faces.

12. The pair of pliers as claimed in claim 1, wherein the first clamping side has a first clamping portion corresponding to and facing the first clamping portion of the second clamping side, and wherein the first clamping portion of the first clamping side has a flat face.

13. The pair of pliers as claimed in claim 1, wherein the first clamping portion of the second clamping side includes two serrated faces disposed separately and the clamping recess is disposed between the two serrated faces.

14. The pair of pliers as claimed in claim 13, wherein the two serrated faces each include first and second sides and a plurality of teeth disposed therebetween, wherein the first sides of the two serrated faces are contiguous to the first side of the clamping recess, wherein the second sides of the two serrated faces are contiguous to the second side of the clamping recess, and wherein tips of the plurality of teeth of the two serrated faces extend longitudinally between the first and second sides of the two serrated faces.

15. The pair of pliers as claimed in claim 13, wherein the tips of the plurality of teeth of the two serrated faces, the first high tooth, and the at least one tooth are parallel to one another.

16. The pair of pliers as claimed in claim 13, wherein the two serrated faces each include first and second sides and a plurality of teeth disposed therebetween, wherein the first sides of the two serrated faces are contiguous to the first side of the clamping recess, wherein the second sides of the two serrated faces are contiguous to the second side of the clamping recess, and wherein tips of the plurality of teeth of the two serrated faces extend longitudinally in a direction substantially parallel to the first and second sides of the two serrated faces.

17. The pair of pliers as claimed in claim 13, wherein the two serrated faces each include first and second sides and a plurality of teeth disposed therebetween, wherein the first sides of the two serrated faces are contiguous to the first side of the clamping recess, wherein the second sides of the two serrated faces are contiguous to the second side of the clamping recess, wherein tips of the plurality of teeth of the two serrated faces extend longitudinally in a direction substantially parallel to the first and second sides of the two serrated faces, and wherein the plurality of teeth of the two serrated faces is adapted to mesh with the plurality of teeth of the first clamping portion of the first clamping side.

18. The pair of pliers as claimed in claim 1, wherein the first high tooth is unsymmetrical.

* * * * *